US012325553B2

(12) United States Patent
Spinaccè

(10) Patent No.: US 12,325,553 B2
(45) Date of Patent: Jun. 10, 2025

(54) PARTICULARLY PRACTICAL DRIP CATCHER

(71) Applicant: Emanuela Spinaccè, Polcenigo (IT)

(72) Inventor: Emanuela Spinaccè, Polcenigo (IT)

( * ) Notice: Subject to any disclaimer, the term of this patent is extended or adjusted under 35 U.S.C. 154(b) by 22 days.

(21) Appl. No.: 18/377,090

(22) Filed: Oct. 5, 2023

(65) Prior Publication Data

US 2024/0116676 A1 Apr. 11, 2024

(30) Foreign Application Priority Data

Oct. 5, 2022 (IT) ..... 102022000020511

(51) Int. Cl.
*B65D 23/06* (2006.01)

(52) U.S. Cl.
CPC ..... *B65D 23/065* (2013.01)

(58) Field of Classification Search
CPC ..... B65D 23/065; B65D 23/06; B65D 47/40; B65D 51/244; B65D 75/38; B65D 81/268; B65D 81/3858
See application file for complete search history.

(56) References Cited

U.S. PATENT DOCUMENTS

| | | | | |
|---|---|---|---|---|
| 7,992,586 | B1 * | 8/2011 | Bovee | B67D 1/1256 220/571 |
| 2001/0030208 | A1 * | 10/2001 | Iggulden | B65D 23/065 428/354 |
| 2010/0187256 | A1 * | 7/2010 | Draisma | B65D 23/065 40/310 |
| 2018/0317680 | A1 * | 11/2018 | Povey | B65D 23/065 |

FOREIGN PATENT DOCUMENTS

| | | | |
|---|---|---|---|
| DE | 886857 | C | 8/1953 |
| DE | 202006006154 | U1 | 6/2006 |

OTHER PUBLICATIONS

May 16, 2023 Search Report issued in Italian Patent Application No. 202200020511.
May 16, 2023 Written Opinion issued in Italian Patent Application No. 202200020511.

* cited by examiner

*Primary Examiner* — Kareen K Thomas
(74) *Attorney, Agent, or Firm* — Oliff PLC

(57) ABSTRACT

A drip catcher for containers, and particularly, a drip catcher that is particularly practical and very versatile, above all suitable for necks of bottles containing liquids which can easily drip when poured.

14 Claims, 15 Drawing Sheets

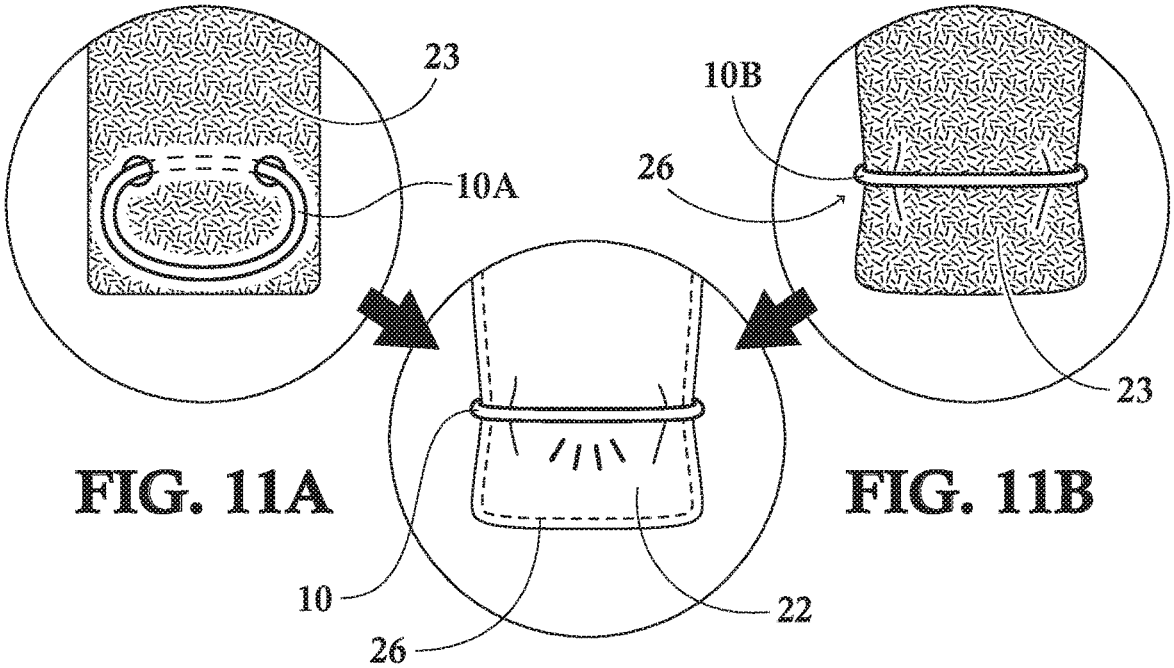
FIG. 11A
FIG. 11B
FIG. 11C
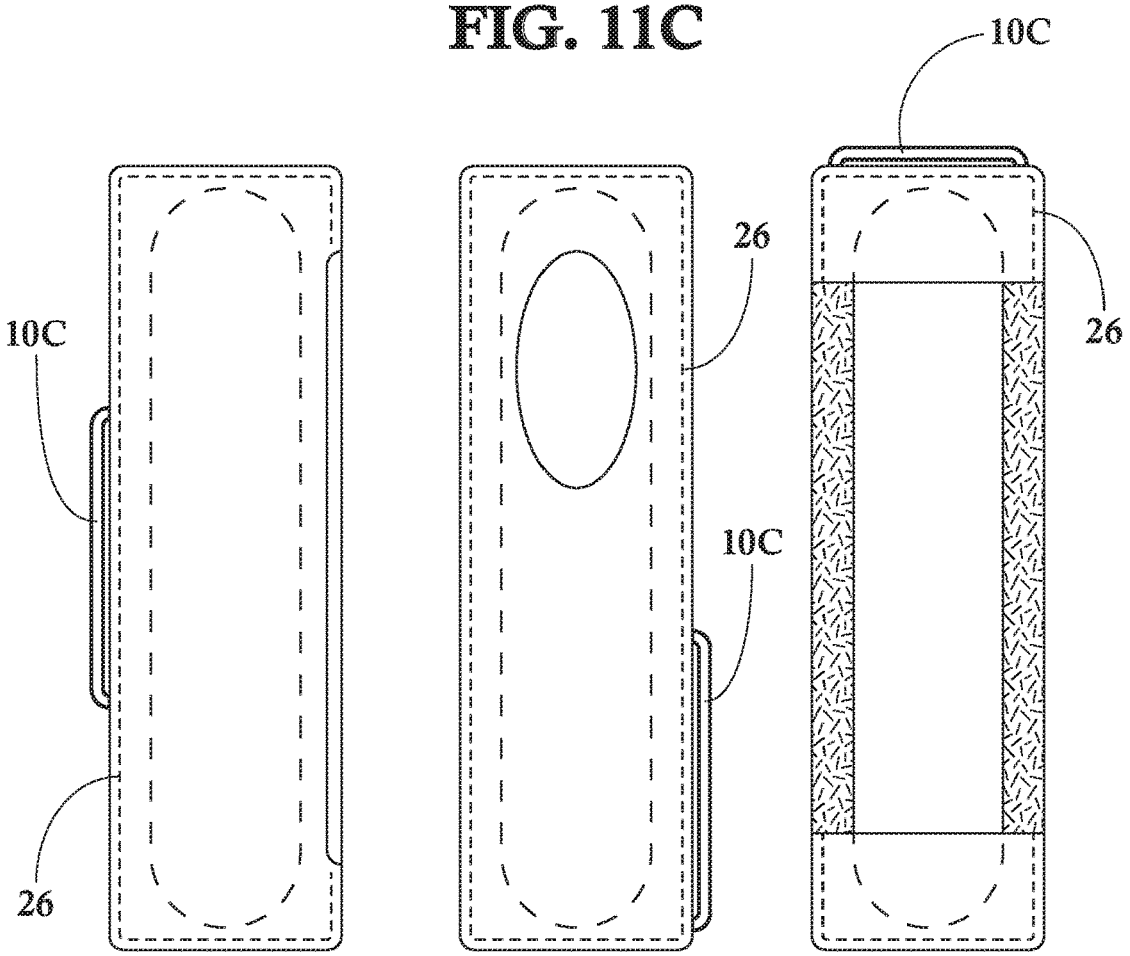
FIG. 12A FIG. 12B FIG. 12C

PARTICULARLY PRACTICAL DRIP CATCHER

TECHNICAL FIELD OF THE INVENTION

The present invention relates to a drip catcher for containers, and specifically, to a drip catcher that is particularly practical and very versatile, above all suitable for necks of bottles containing liquids which can easily drip when poured.

STATE OF THE PRIOR ART

Various designs of drip catchers are available on the market. The most common ones include simple cloth strips to be tied around the neck of a container so as to absorb the drops that drip upon opening. An alternative device is represented by a rigid ring which can be fitted on the neck of a bottle and provided with a cloth on the inner surface thereof for absorbing the drops. Another solution provides for a thin disc made of metal material, preferably aluminium, which is folded and inserted into the mouth of a bottle; therefore, when the content is poured the thin edge of the disc acts as a drip stop element preventing the drops from dripping from the bottle.

More complex devices provide for a portion to be inserted into the neck of the bottle and provided with one or more sealing rings, and a portion which extends outside the bottle with a drip catcher spout which can be possibly closed with a special hinged cap.

A further solution is represented by an elastic metal strip having a surface covered by an absorbent material. The strip can be snap-folded with the absorbent surface in contact with the neck of a bottle.

Among the aforementioned solutions the most effective one is the aluminium disc. Furthermore, it is easy to manufacture and maintain. On the contrary, there arises the need for a relative manual fitting skill and it can be easily ruined due to the thinness of the material.

The cloth strips are easy and cost-effective to manufacture, also allowing a very appealing customisation especially for winemakers who can offer the drip catcher as a free gift for promotional purposes. However, even such strips require significant manual fitting skills, or they require engagement elements between two end strips such as Velcro, snap fasteners, slots and relative buttons or hooks. Basically, just like in the case of the disc solution, there arises the need to use two hands to prepare the device and often even to remove it from the neck of the bottle.

The rigid ring with internal cloth is easy to fit but it requires significant processing for the manufacture thereof and, above all, it is difficult to clean.

The covered snap-coupling metal strip is also easy to fit but it is difficult to clean given that it is easy to activate the snap-coupling which folds it over itself by acting on the absorbent surface. A strip of this type is for example described in document DE202006006154U1 in which a strip made of absorbent material is attached to a snap-coupling strip using an adhesive.

SUMMARY OF THE INVENTION

Therefore, the technical problem underlying the present invention lies in providing a drip catcher that is practical, versatile, easy to use, easy to clean and durable.

Such problem is overcome by a drip catcher provided with a structure that is very simple but practical and easy to fit to the neck of a container.

Therefore, a first object of the present invention is a drip catcher that is easy to fit with only one hand.

A second object is a drip catcher that is versatile to adapt to various sizes of the neck of the containers.

A third object is a drip catcher that is easy to manufacture and, therefore, cost-effective.

BRIEF DESCRIPTION OF THE FIGURES

Further characteristics and advantages of the drip catcher according to the present invention will become more apparent from the following description of some embodiments provided purely by way of non-limiting example with reference to the following figures, wherein:

FIGS. 3A-3B respectively show a plan and front view of a second component of the drip catcher of FIG. 1;

FIGS. 4A-4B respectively show a plan view of the second component of FIG. 3 partially and fully inserted into the first component of FIG. 2;

FIGS. 11A-11C show three particular embodiments of the variant of FIGS. 7A-7C;

FIGS. 12A-12C respectively show three plan views of three further variants of the drip catcher of the invention;

DETAILED DESCRIPTION OF THE INVENTION

Figure 1:
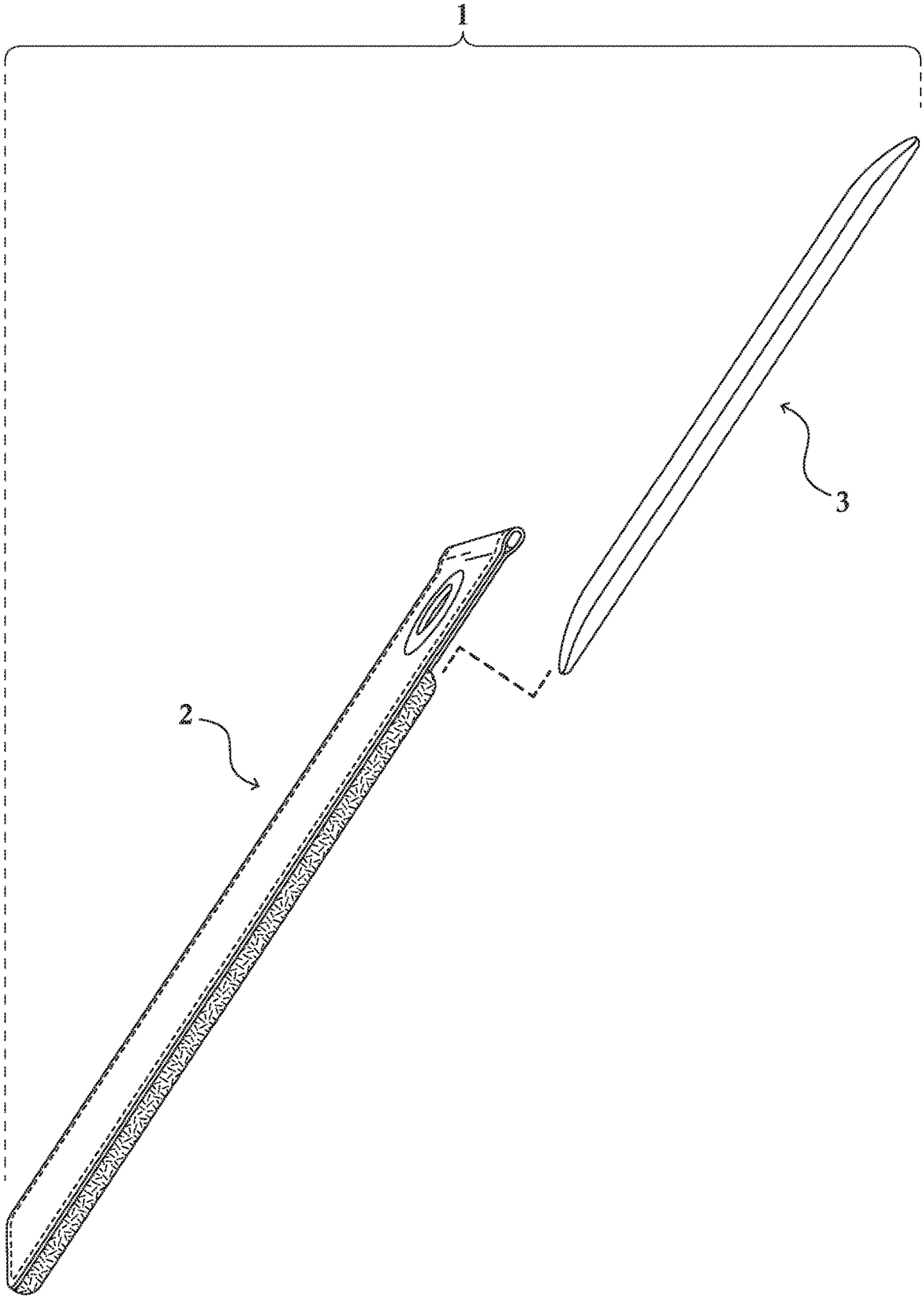
FIG. 1 shows an axonometric schematic view of the exploded view of the drip catcher according to the invention in one embodiment.

With reference to FIG. 1, the drip catcher of the invention is generally indicated with reference numeral 1 and it comprises a first component 2 and a second component 3 which can be assembled to make the device usable. The first component 2 is a cloth strip provided with at least one absorbent surface of contact with the neck of a container. The second component 3 is formed by means for reversibly fitting around said neck.

Figures 2A, 2B, 2C:
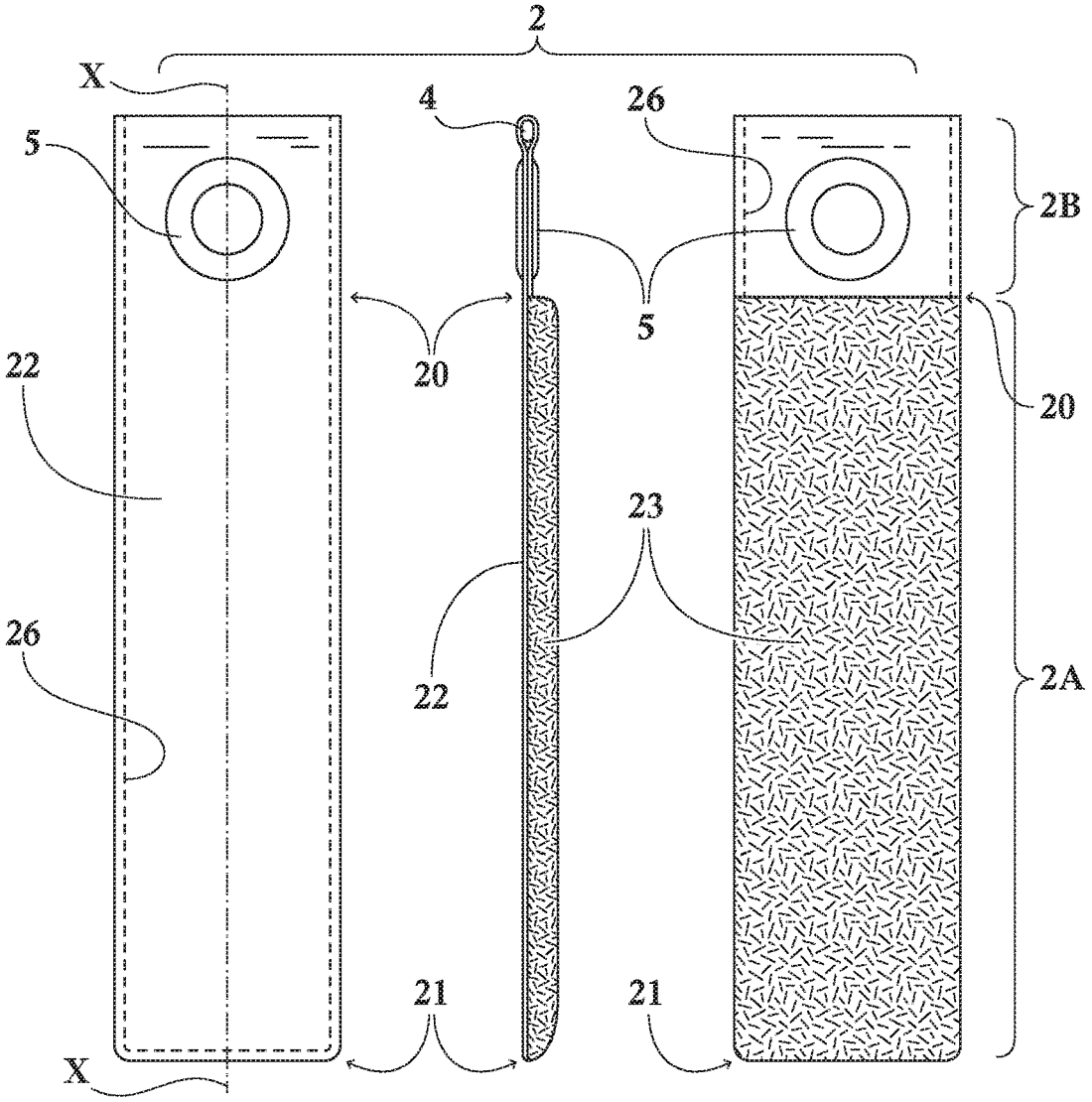
FIGS. 2A-2D respectively show a plan view from a first side, a lateral view, a plan view from a second side and an enlarged detail of a first component of the drip catcher of FIG. 1.

In particular, as shown in the FIGS. 2A-2B, the cloth strip 2 extends on a rectilinear axis X-X preferably rectangular-shaped from a first end 20 to a second end 21. Furthermore, the strip has a first surface 22 opposite to a second surface 23, both generally flat. At least the second surface 23 is formed by an absorbent material made of non-woven fabric, such as for example a cotton, sponge or micro-fibre fabric. The first surface 22 may also be made of absorbent material or any material made of fabric, non-woven fabric, soft or elastic plastic material carrying the absorbent material of the second surface 23. Preferably, the first surface 22 is made of printable material to allow customisation depending on the specific needs or preferences.

Figure 2D:
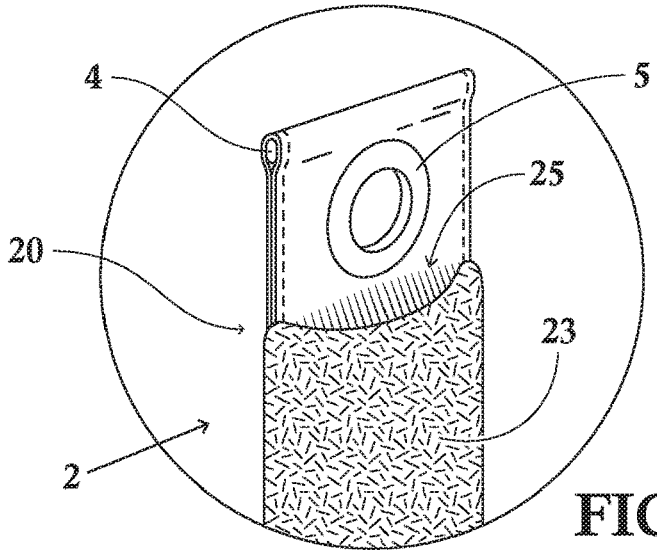

Advantageously, the cloth strip 2 comprises a pocket 24 (indicated in FIGS. 4A-4B), preferably provided with an opening 25 (better observable in FIG. 2D), for containing the aforementioned means 3 for fitting the drip catcher around the neck of the container. The pocket 24 is preferably formed by joining a piece of absorbent cloth with another piece of cloth along at least part of the respective contour edges. Preferably, the two pieces are joined by stitching 26 (FIG. 2A) along three of the four contour edges which form the rectangular strip 2 so as to form the aforementioned first 22 and second 23 surface, between which the pocket 24 is created. In other words, the piece of soft absorbent cloth is sewn or joined to another support piece, or a piece of absorbent cloth is folded and sewn thereon forming the aforementioned pocket. In addition, the pocket may be formed by gluing, hot stamping or other known means for joining edges such as Velcro, snap fasteners and the like.

It should be observed that the pocket 24 may be variously shaped depending on specific needs or preferences. For example, as shown in the FIGS. 4A-4B, the pocket is rectangular and it substantially extends over the entire strip 2. Preferably, it is provided with an opening 25 located at the first end 20 (FIG. 2D) of the strip or, alternatively, of the second end 21. Furthermore, it may be reversibly closed/sealed, for example using zips, buttons, Velcro, or other.

Figures 3A, 4A, 4B:
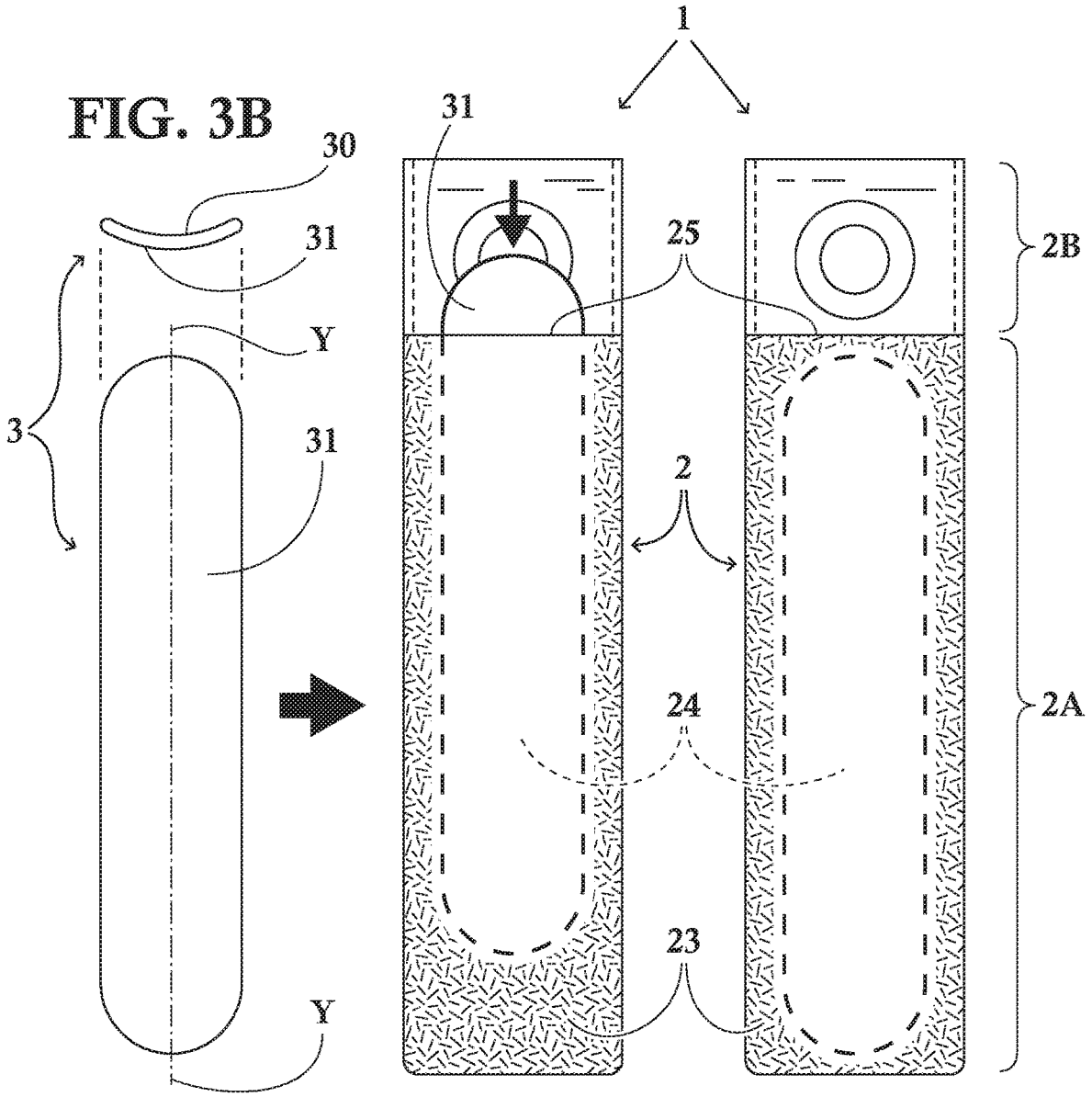

As schematically shown in FIGS. 3A-3B, advantageously, the fitting means 3 comprise a metal strip which is extended on a rectilinear axis Y-Y, it has a curved cross-section, it can be elastically snap-deformed by pressing with the fingers of one hand and it can be housed in the aforementioned pocket 24 of said cloth strip 2. In particular, the strip 3 comprises a first concave face 30 opposite to a second convex face 31; the second convex face 31 is the face designed to be positioned around the neck of the container, as explained below.

The metal strip 3, as shown in the example of FIGS. 4A-4B, is inserted into the pocket 24 through the opening 25 so that the second convex face 31 is arranged facing towards the second surface 23 of the strip 2. At this point, the drip catcher 1 may be approached to the neck of a container being arranged horizontally, that is transversely to the longitudinal axis of the neck, with the second surface 23 thereof towards the neck. In this position, it suffices to press with two fingers of a hand, for example the thumb on the second surface 23 and index transversely on the first surface 22 at an end of the strip 2, to snap-actuate the strip 3 so as to obtain the folding thereof around the neck of the container. In other words, the strip is elastically deformable so as to adapt around the neck of a container due to its ability to coil around itself after pressing the fingers of one hand which flatten the curved section on an end of the strip.

According to a first variant embodiment, as shown in the FIGS. 5B-5E, the drip catcher of the invention may comprise an activation element 4 preferably represented by a rigid plate positioned transversely astride one of the ends of the strip 3 and on the side of its first concave surface 30. This element allows to facilitate the activation of snap-action of the strip given that one can simply press—with the fingertips—on the plate without being positioned astride, as described above; for example, the tip of the thumb on the first surface 22 above the plate 4 and tip of the index finger on the second surface 23.

Figure 5A:
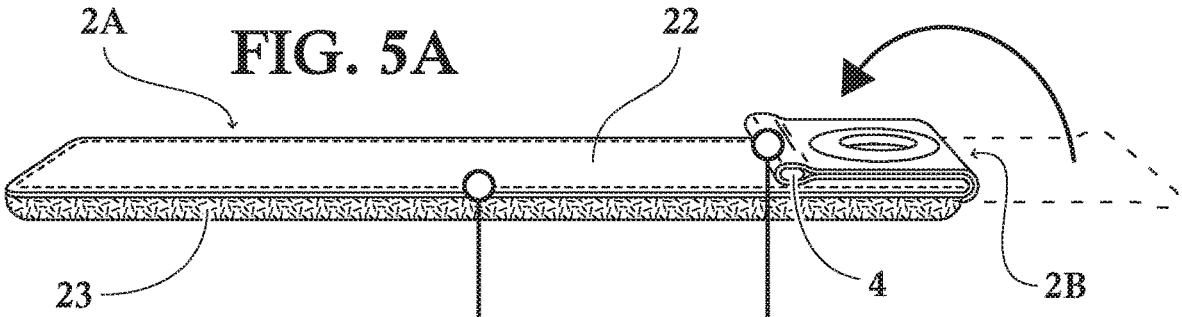
FIGS. 5A-5E respectively show an axonometric view of the drip catcher of FIG. 1 in a first activation step, with or without the first component, an axonometric view of the second activated component, a cross-sectional view of the second component in the first activation step and a cross-sectional view of the second component in the activation step.
Figure 5B:
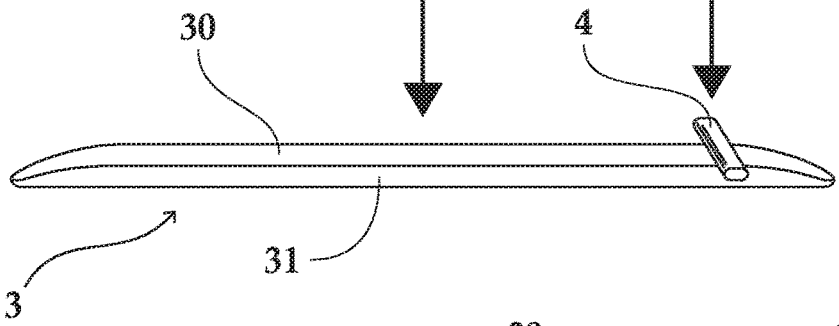
Figure 5C:
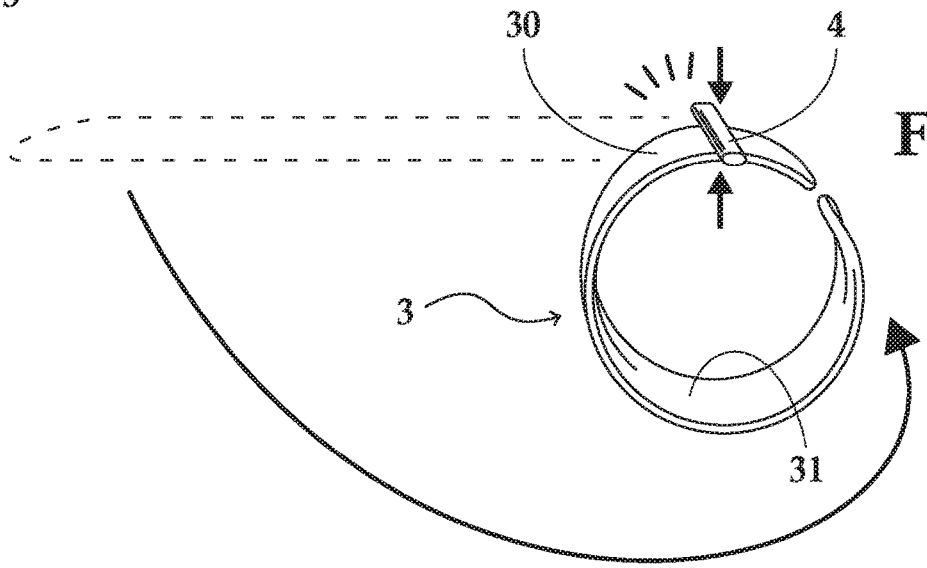
Figure 5D:
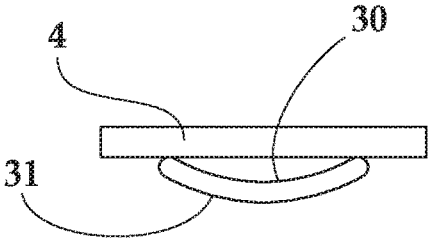
Figure 5E:
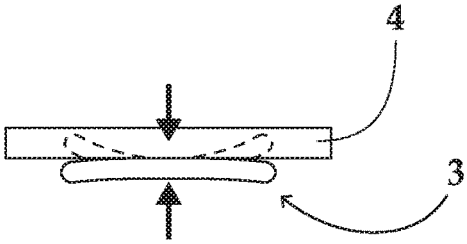
Figure 6A:
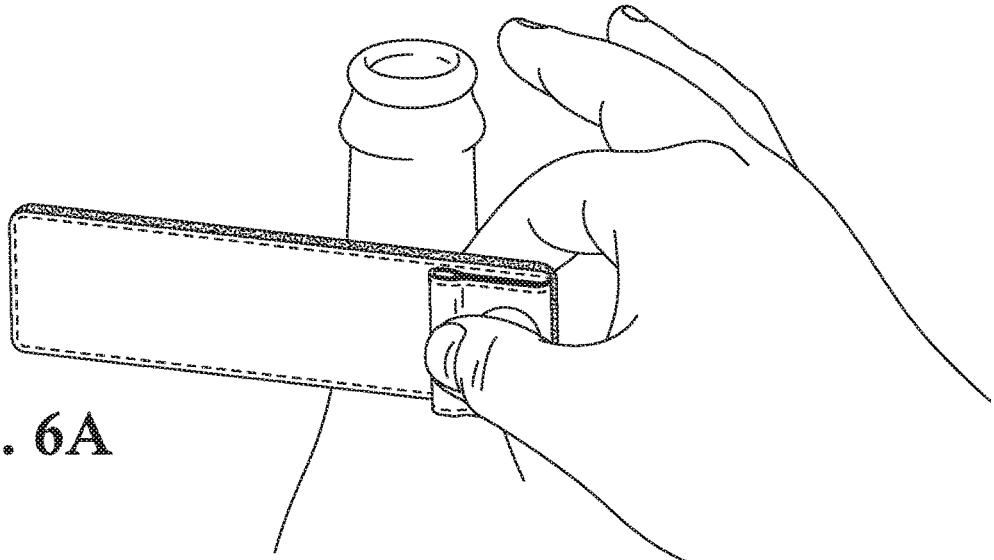
FIGS. 6A-6D show the steps for fitting of the drip catcher of the invention to a neck of a bottle.
Figure 6B:
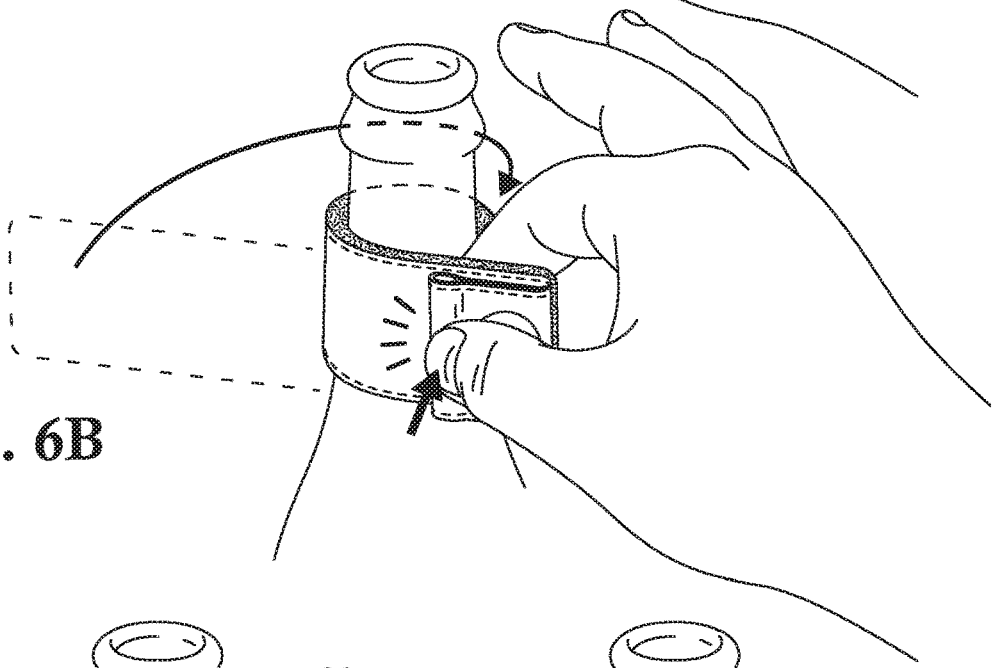

According to a particular embodiment, the strip 2 may comprise an extension of the first end 20 so as to comprise a first main portion 2A, containing the pocket 24, and a second auxiliary portion 2B. In particular, the second portion 2B extends from the first end 20 and covers the aforementioned activation element 4 (see FIGS. 2B and 2D). Preferably, such element is fixed on a transversal edge of said second portion so as to allow the folding of the second portion 2B on the first portion 2A (see FIG. 5A) and allow the aforementioned activation of the snap-action (see FIGS. 5B-5E). As a matter of fact, by folding, the activation element 4 is positioned transversely above the first surface 22 of the strip 2 below which, as explained above, there is the first concave face 30 of the strip 3 (FIGS. 5A and 5B). The pressure of the tips of the thumb and index finger, respectively on the plate 4 and on the second surface 23, causes the snap-action of the strip which folds thereon defining a circle (FIG. 5C) which wraps around the neck of a container (FIGS. 6A and 6B). The activation of the snap-action by pressing causes the flattening of the strip 3 (FIGS. 5D and 5E) so as to allow the perfect adherence of the strip 2 around said neck.

Figure 6C:
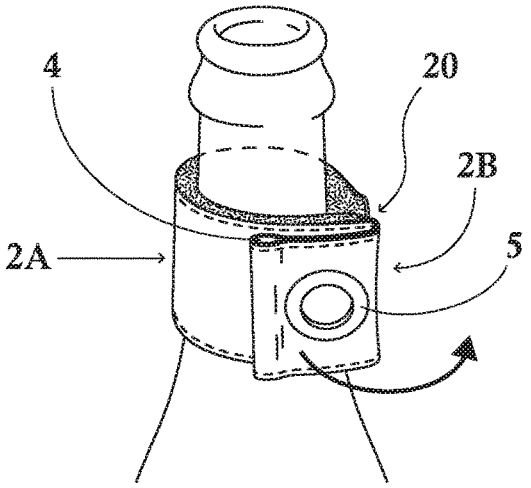
Figure 6D:
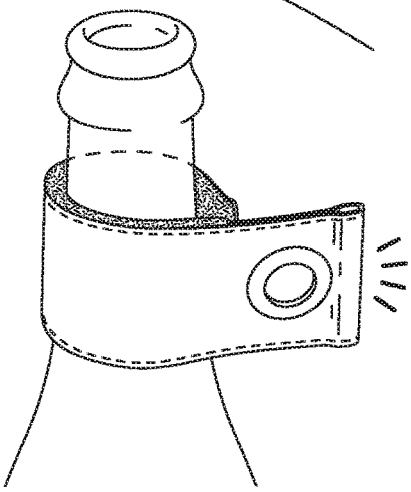
Figure 9:
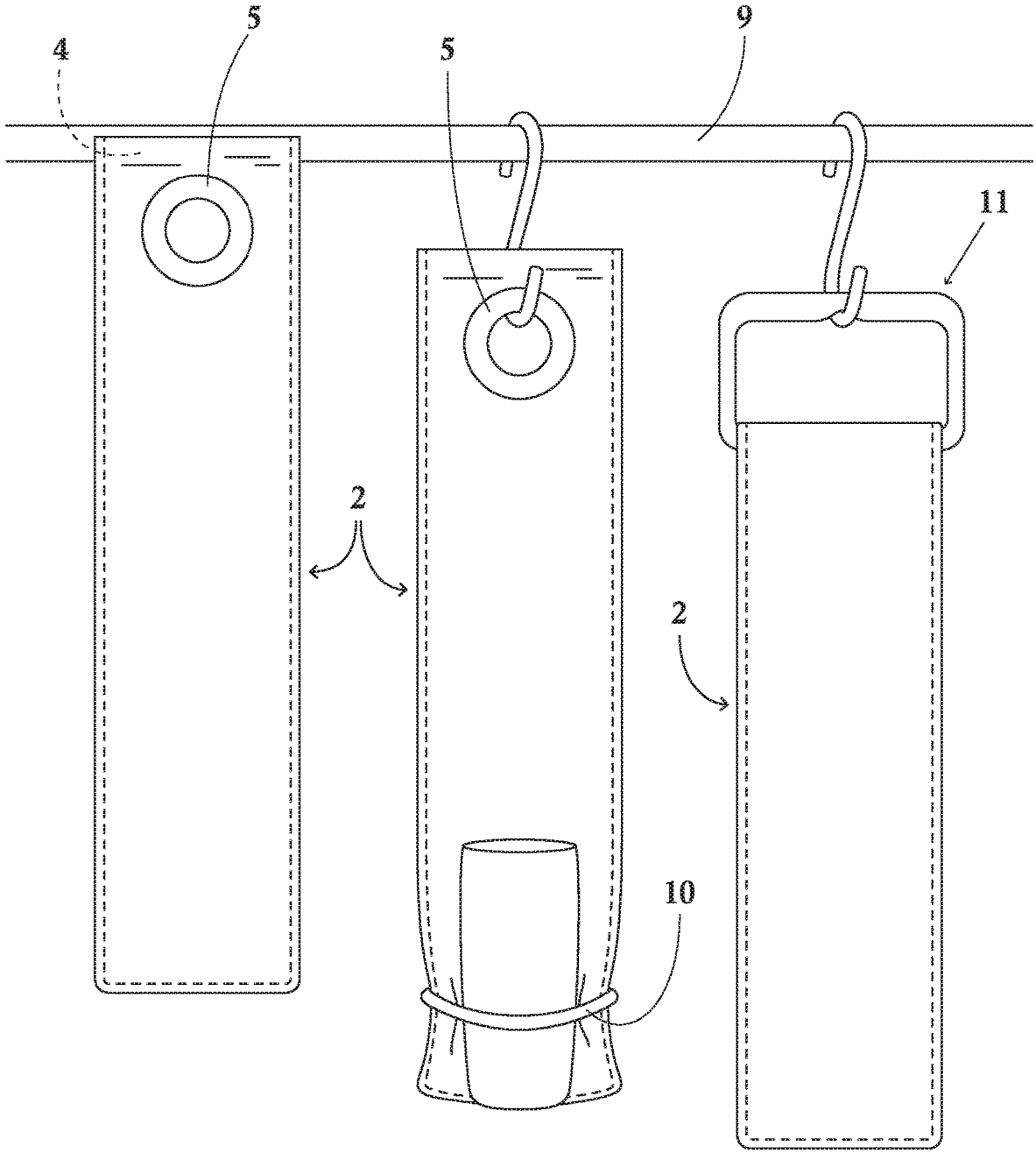
FIG. 9 shows a view of three variants of the drip catcher of the invention fitted to a kitchen tool holder bar.

In a further embodiment, the second portion 2B may comprise a slot 5 so as to be hung—for example—on a kitchen tool holder metal bar 9 through a conventional hook, as shown in FIG. 9. Furthermore, the slot 5 and/or the activation element 4 may be made of magnetised ferrous metal material so that it can be fitted to said bar 9 without the hook or on any metal surface like that of a refrigerator door. In particular, the second portion 2B may remain folded on an end 20 of the strip 2 thanks to the magnetisation of the slot 5 of the activation element 4 (FIG. 6C), or it can be moved away (FIG. 6D) "in a flag-like fashion" to facilitate the grasping and removal from the neck of the container.

Figure 7A:
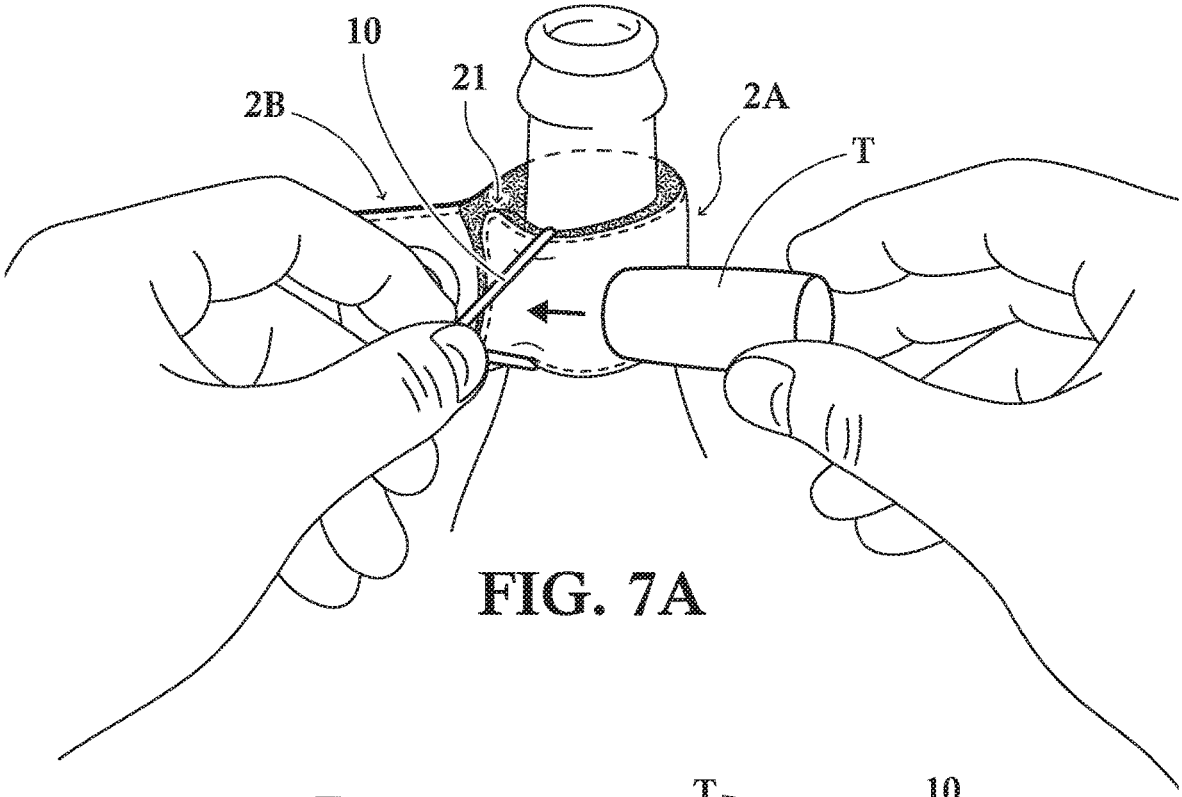
FIGS. 7A-7C respectively show two axonometric views of the drip catcher of the invention according to a variant embodiment, fitted to the neck of a bottle in two operating steps, and a top view of said neck.
Figure 7B:
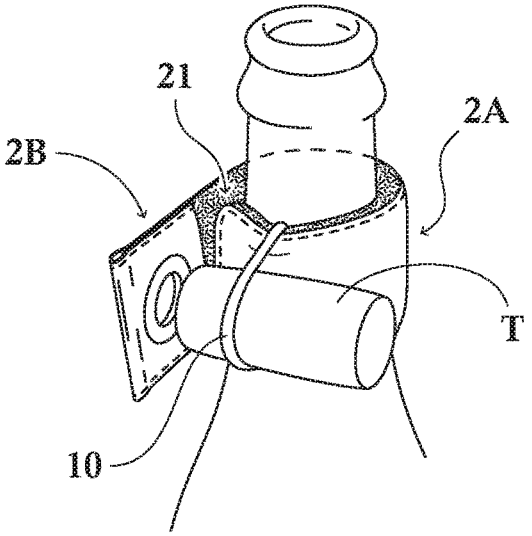
Figure 7C:
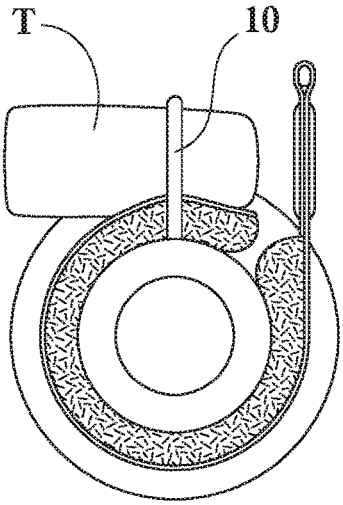
Figures 8A, 8B, 8C:
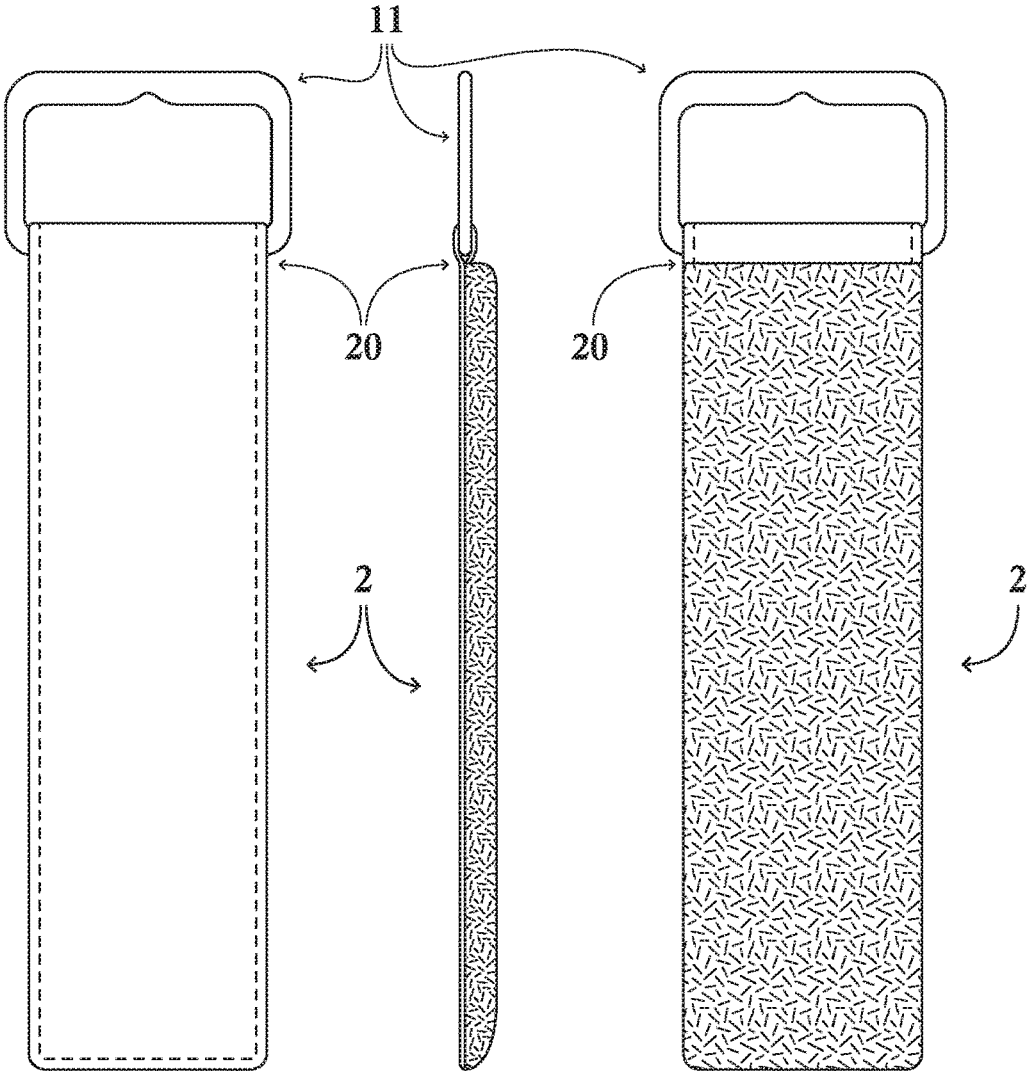
FIGS. 8A-8D respectively show a plan view from a first side, a lateral view, a plan view from a second side and a plan view from the first side in a first step for activating the drip catcher of the invention according to a further variant of the invention.
Figure 8D:
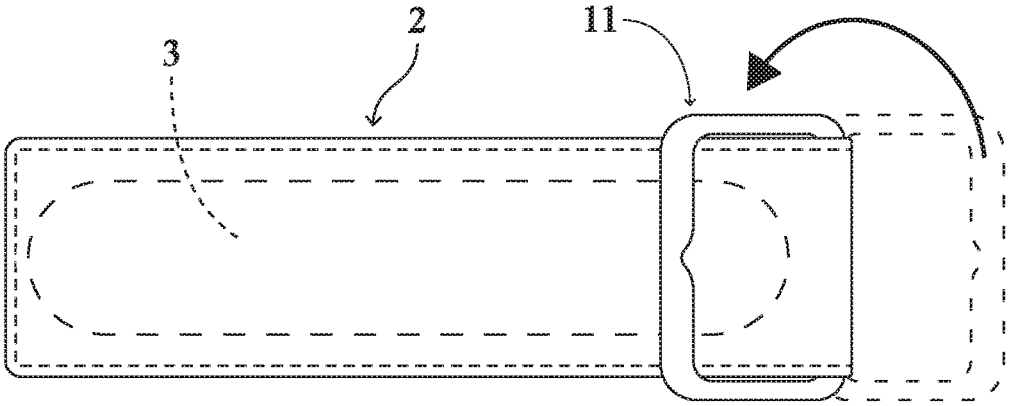

According to a variant of the drip catcher of the invention, said strip 2 also comprises an elastic ring 10 for retaining a cap T of a container (FIGS. 7A-7C), preferably at an end 21 thereof. In this manner, once the drip catcher 1 has been fitted around the neck of the container and the cap has been removed from said neck, the cap may be easily retained without being dispersed in the environment.

According to a further embodiment (see FIGS. 8A-8D), the aforementioned second portion 2B of the strip is formed by a rigid ring 11. Preferably, the rigid ring 11 is generally rectangular-shaped and it can be folded on the strip 2 to position a portion thereof astride the strip 3, as described above with reference to the activation element or plate 4. Furthermore, the rigid ring would allow the engagement on a kitchen bar 9 using a special hook, as shown in FIG. 9, and/or it could be magnetised so that it can be hung directly to the bar or to be fitted to another metal surface such as a refrigerator, as described above.

In the light of the above, it is clear that the drip catcher of the invention has overcome the drawbacks relating to the prior art while achieving significant advantages at the same time.

Firstly, the possibility of separating the snap-coupling folding component from the cloth strip allows an easy washing.

As described, a container can be fit to the neck of a container very easily and precisely because it can be actuated with just two fingers.

Furthermore, it is very versatile given that with the various solutions of the embodiments, one can quicken the operation, for example thanks to the activation element.

The possibility of envisaging a slot allows to hang the drip catcher for a quick positioning thereof, same case applying to the alternative solution of the rigid ring.

Still, the option of magnetising the activation element, the slot or the rigid ring offer the further advantage of allowing to quickly put away the drip catcher in various positions in a kitchen.

The further elastic ring for retaining the cap of a container offers the advantage of a tidier table.

The drip catcher of the invention is also susceptible to further variants all within the reach of the person skilled in the art but without departing from the scope of protection of the attached claims.

For example, the materials used for the cloth strip may be cotton, microfibres, natural or synthetic sponge at least for the second surface in contact with neck of the bottle. The shapes may vary depending on the particular needs or preferences, while maintaining the pocket for the snap-coupling folding component. Although the first surface may be made of a printable cloth or a cloth covered by printable plastic material on which logos, writings or decorations can be printed at will.

Figures 10A, 10B, 10C:
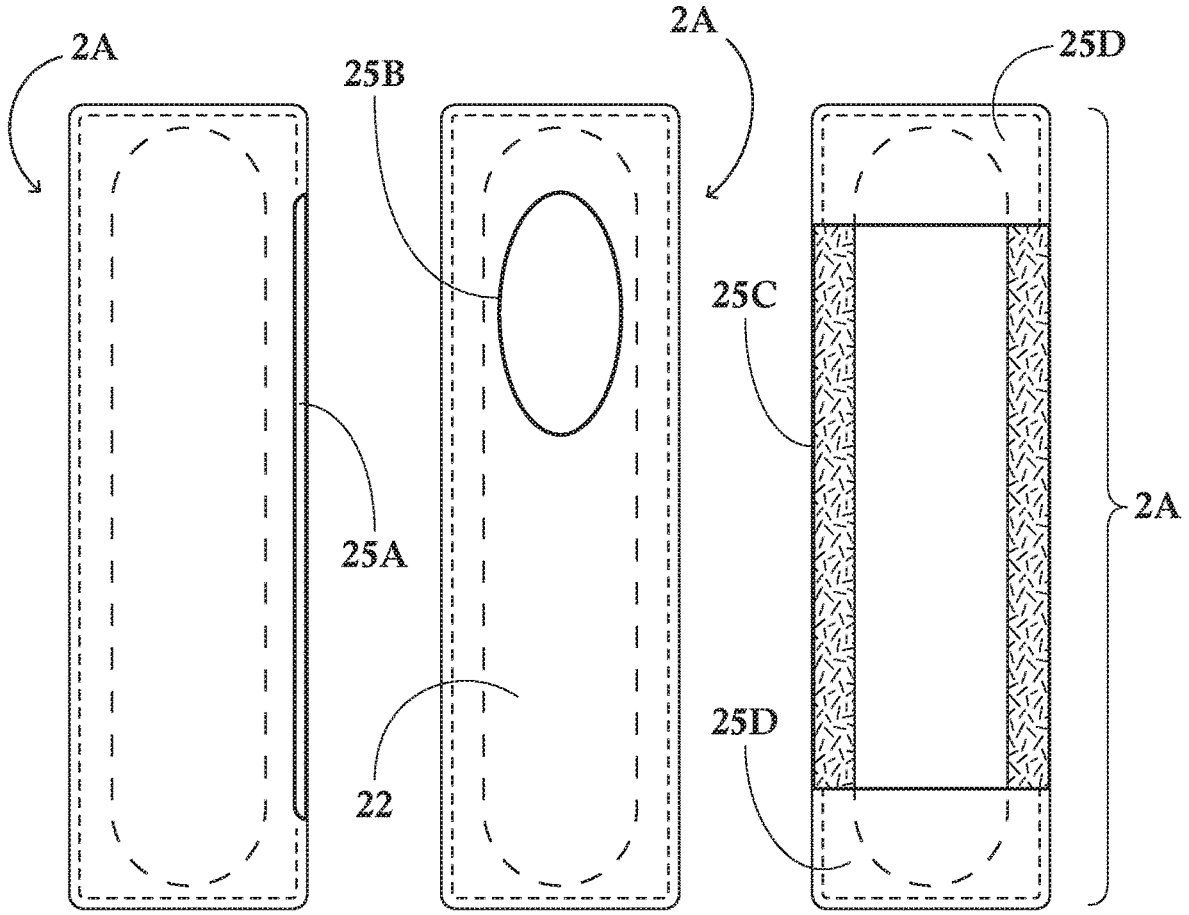
FIGS. 10A-10C respectively show three variants of a pocket for containing the first component for the second component of the drip catcher of the invention.
Figure 13A:
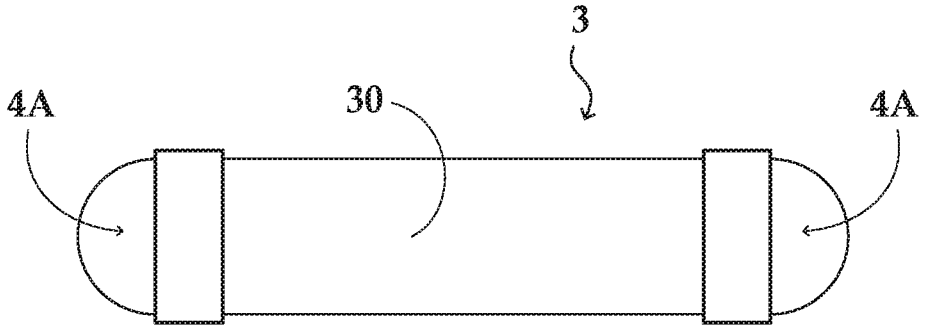
FIGS. 13A-13D show a plan view respectively of four embodiments of an activation element of the second component of the drip catcher of the invention.
Figure 13B:
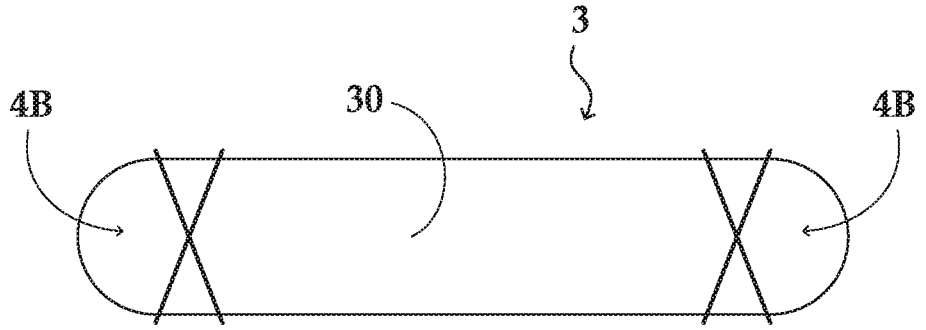
Figure 13C:
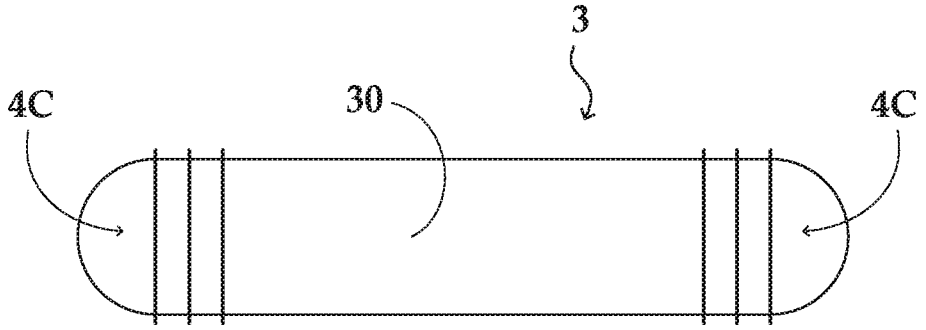
Figure 13D:
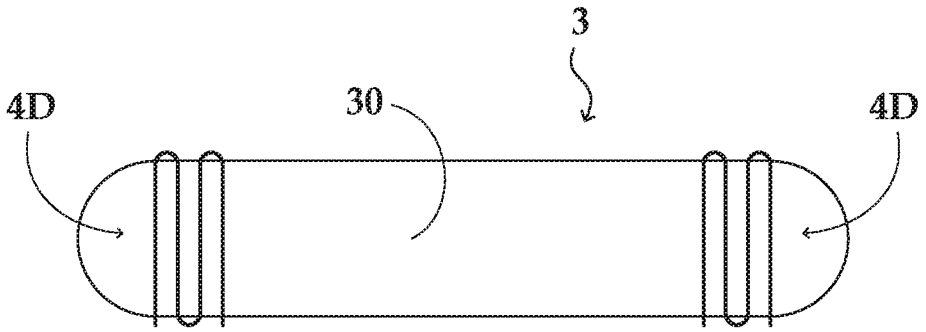

According to further variants (FIGS. 10A-10C), the opening 25 of the cloth strip 2 can be a more or less broad window into which fitting means can be inserted fand then blocked by portions or flaps of the fabric of the cloth of the pocket. In these cases, the fabric may be elasticised so as to allow an easy insertion of the fitting means into the pocket 24. For example, the opening 25 may be a fissure 25A along the longitudinal edge of the strip 2 formed by the main portion 2A (FIG. 10A) only. Alternatively, it may be a window 25B obtained in various shapes, for example an ellipse (see FIG. 10B), on the first surface 22, preferably in proximity of an end of the strip 2 still formed by the main portion 2A only. In a further version, the opening 25C may extend almost over the whole the first surface 22 of the strip 2 leaving two small pockets 25D at the ends of the strip which can be engaged by corresponding ends of the metal strip 3 (FIG. 10C).

It should be borne in mind that the aforementioned variants of the opening 25 may also apply to the strip comprising both the main 2A and auxiliary 2B portions described above.

In addition, the elastic ring 10 may also be fixed/engaged directly on the second surface 23 of the strip 2 (by stitching or other engagement means) so that, if not positioned on the first surface 22 for use (FIG. 11C), remains concealed (FIG. 11A), as indicated by the reference numeral 10A (FIG. 11A). Another method of fitting the elastic ring 10 consists in engaging it by stitching 26 (or other engagement means) transversely with respect to the longitudinal axis X-X, so that, if not positioned on the side 22 for use (FIG. 11C), it can also remain concealed, as indicated by the reference numeral 10B (FIG. 11B).

A further method for fitting the elastic 10 consists in positioning it/fixing it (for example by stitching 26 or other engagement means) in any point around the perimeter edge of the strip 2, as indicated by the reference numerals 10C in FIGS. 12A-12C. In this case, the elastic ring is not concealed but it however remains almost "imperceptible" because it is "placed" on the edge. In all variants, the elastic may also be used as engagement means instead of the aforementioned slot or rigid ring.

The pocket 24 may also receive, besides the second component 3, one or more elements adapted to increase the absorbing capacity and the retention of the poured liquids, such as for example spongy materials, technical/dry-tech materials, and other materials, or means for indicating temperature, moisture or other parameters.

The activation element 4 or plate may be fixed/engaged directly on the concave face 30 on one or both ends of the second component 3 or strip of the drip catcher 1, or it can be fixed on the first surface 22 (outside or inside the pocket 24) of the strip. Furthermore, the strip 3 with the plate 4 directly fitted may be inserted into any of the strips 2 described above, therefore creating variants of drip catcher 1 in which the activation element 4 is not inserted into the cloth strip 2.

With reference to FIGS. 13A-13D, there are shown four embodiments of the activation element 4. In particular, in FIG. 13A, such element is a flat and rectangular plate 4A sealed or glued astride on the raised edges of the first surface 30 of the strip 3; in FIG. 13B, it is formed by two bars 4B made of rigid material sealed or glued on said strip 3 being crossed to form an X to create a double bridge with only one pressing point positioned at the centre; in FIG. 13C, it is formed by three parallel bars 4C still made of rigid material and fixed like mentioned above; in FIG. 13D, it is formed by a single rigid serpentine 4D, still arranged astride so as to have several support points on the raised edge of the strip 3. It should be observed that the various embodiments may also be expanded/extended and/or replicated along the longitudinal line the second component 3 to expand the area on which the pressure is exerted with the fingertips hence making the activation of the snap-action even more practical. The element 4 may further be irreversibly fixed (for example sealed or glued) or reversibly fitted (for example engaged or through inserted between two opposite transversal holes) to the second component 3 so as to adjust the position thereof along the longitudinal line.

Figure 14A:
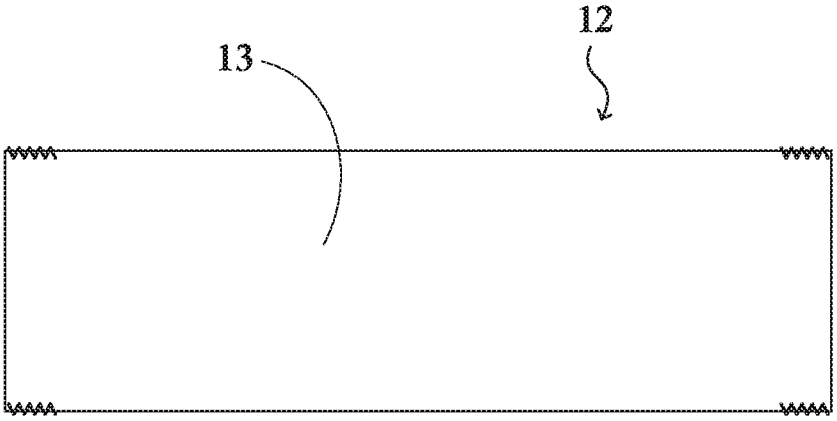
FIGS. 14A and 14B represent two plan views of two opposite sides of a cover for the drip catcher of the invention.
Figure 14B:
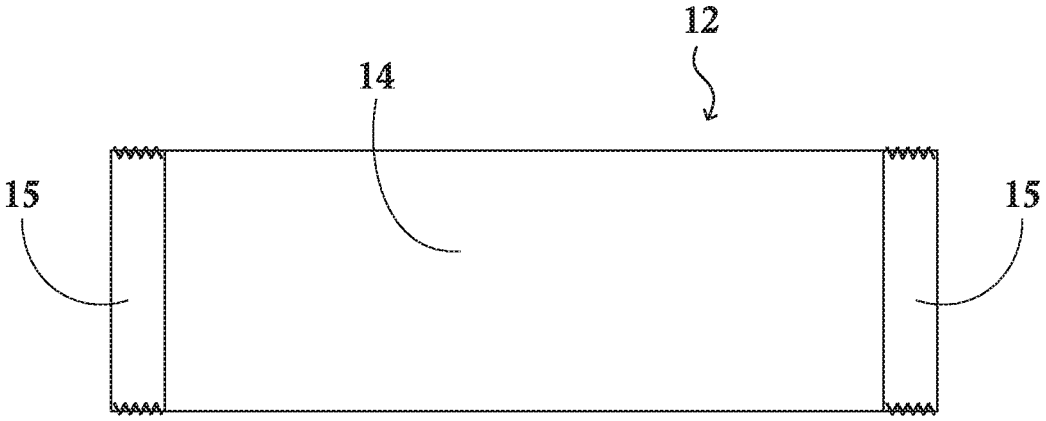
Figure 15:
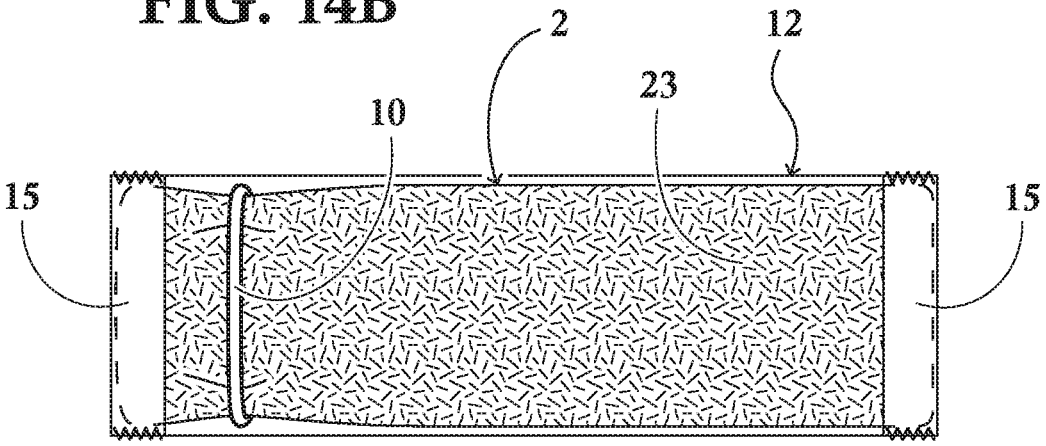
FIG. 15 shows a view—from one side—of the cover of FIG. 14 applied to a drip catcher of the invention.

According to still another variant (FIGS. 14A e 14B), the drip catcher 1 of the invention comprises a cover 12 formed by a strip made of flexible material, preferably water-repellent such as for example plastic, having a first face 13 or outer face and a second face 14 or inner face. Wordings, logos, colours or drawings can be printed on the first face 13 at will. The cover 12 advantageously comprises fitting means 15 adapted to reversibly fit it on the first surface 22 of the strip 2. These fitting means may be two pockets sewn on the second face 14 at the ends of the strip of material so as to receive the respective ends of the strip 2 of the drip catcher 1, as shown in FIG. 15. Alternatively, the cover may be fitted on the first surface 22 using Velcro, snap fasteners, eyelets and relative buttons and other known engagement means for example of the clothing industry.

It should be borne in mind that the cover will be fitted only on the first surface 22 of the strip 2, leaving substantially entirely vacant the second surface 23 which will therefore be wound around the neck of a container, as explained above, without affecting the crucial operation of the drip catcher. Furthermore, the cover may easily adapt to many of the aforementioned variants, like the one with elastic ring 10 for retaining the cap (FIG. 15).

The advantage of the cover—such as the additional component of the drip catcher of the invention—lies in offering several covers that are customised and easy to produce for each single drip catcher. Furthermore, it acts as a protection for a longer life of the drip catcher.

Figures 16A, 16B:
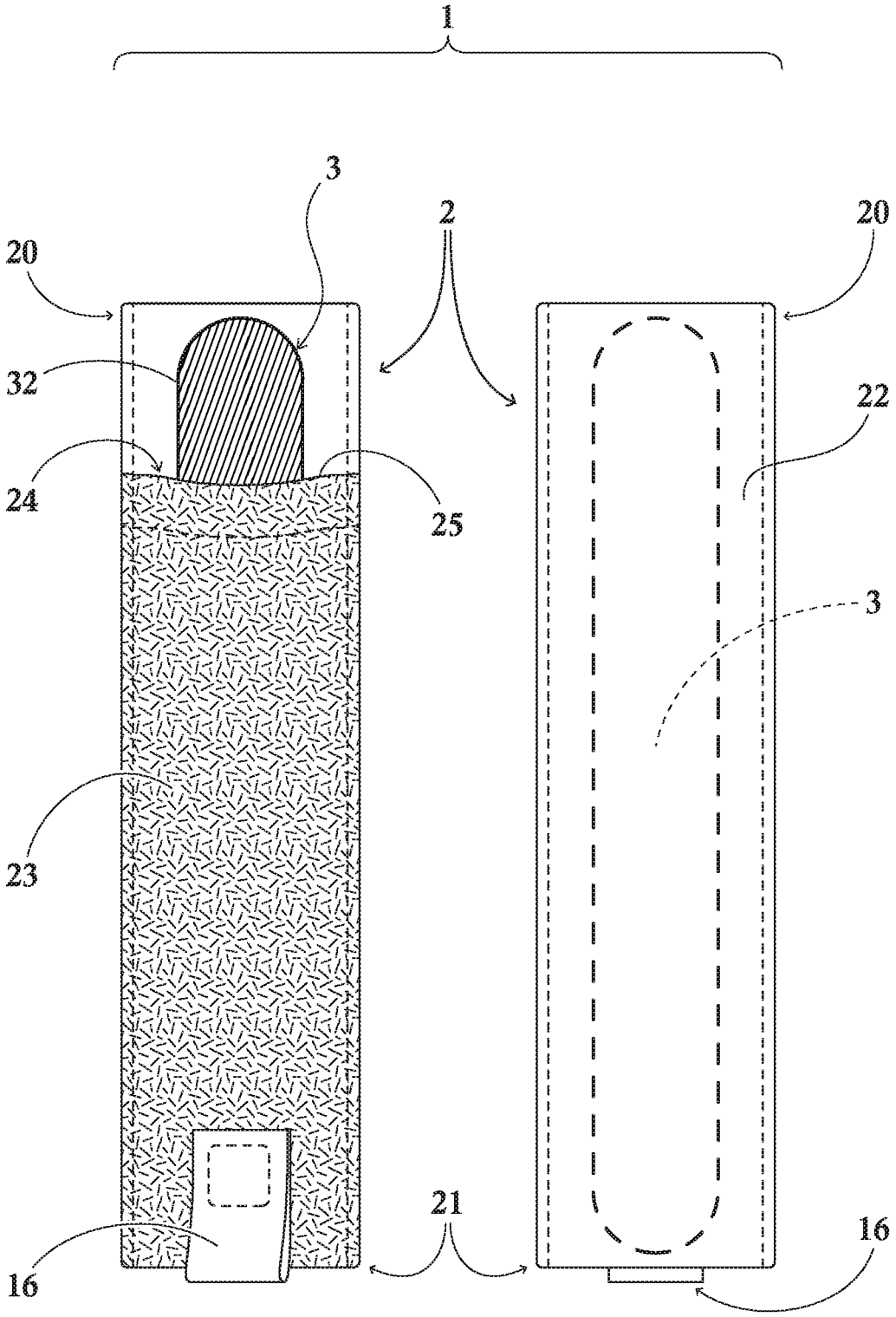
FIGS. 16A and 16B respectively show a plan view—from one side—and—from the opposite side—of a further variant of the drip catcher of the invention.

According to still another variant, the pocket 24 of the cloth strip 2 leaves vacant, that is it does not cover, a terminal portion of the metal strip 3 at least on one side, as shown in FIG. 16A, for example it leaves the second convex face 31 uncovered.

Preferably, the cloth entirely covers the length of the strip—on one side—and—on the other side—the cloth ends at a given distance leaving approximately one fifth of the strip preferably uncovered. For example, as shown in the FIGS. 16A and 16B, the first end 20 of the cloth strip 2 does not comprise the pocket 24 and leaves an end portion 32 of the strip uncovered on one side. In other words, the second surface 23 of the cloth strip does not fully cover the first surface 22. It should be observed that the cloth strip 2 may have the second surface 23 protruding with respect to the first surface 22 leaving the first concave face 30 of the end portion 32 of the strip 3 vacant. Furthermore, both the first 22 and second 23 surfaces may leave the end portion 32 of the strip uncovered. However, in all the cases mentioned above, the metal strip may be easily removed from the pocket thereof.

Figures 17A, 17B:
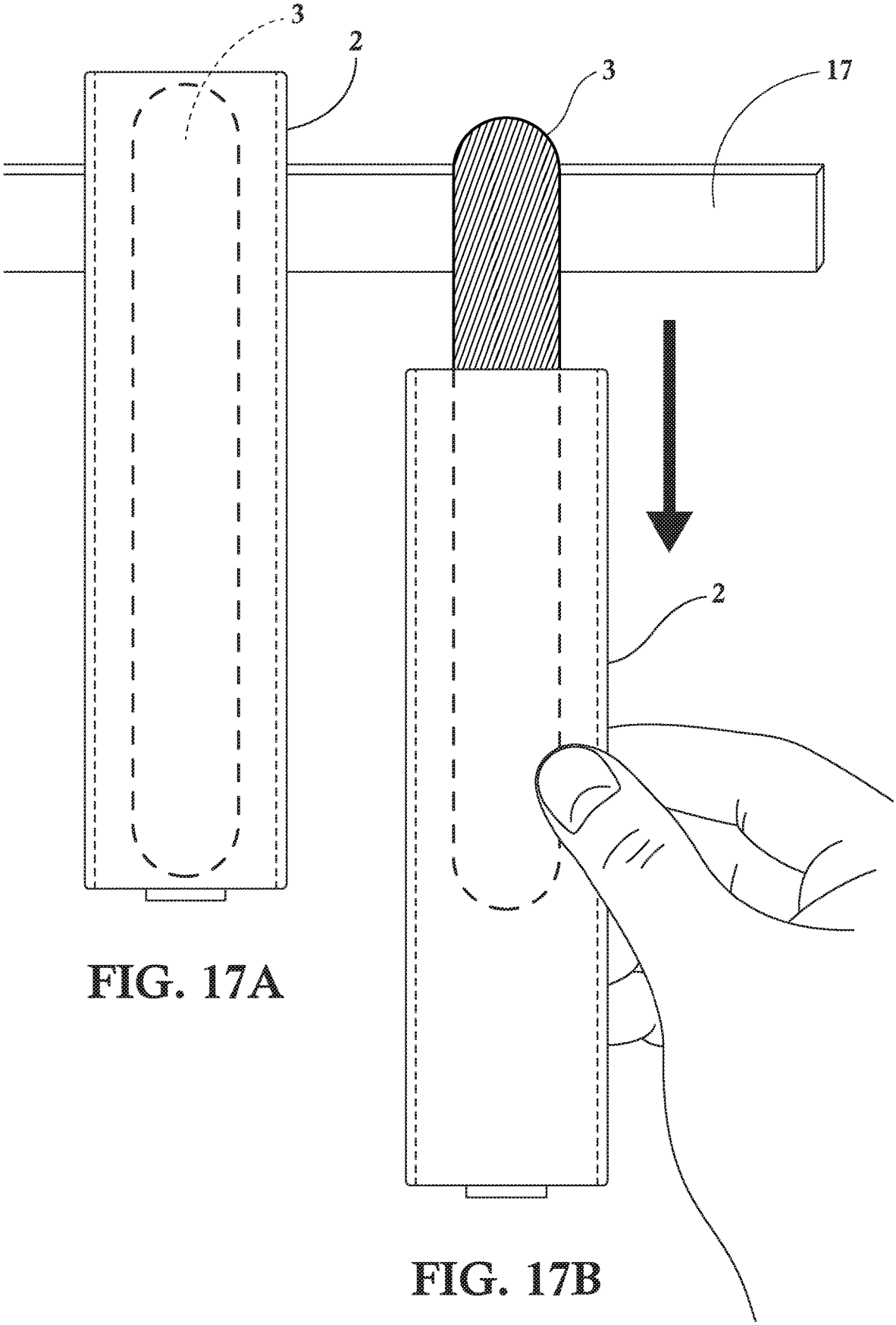
FIGS. 17A and 17B respectively show a view of the drip catcher of FIG. 16 hung on a support and a view thereof in a step for removing the cover.
Figure 18A:
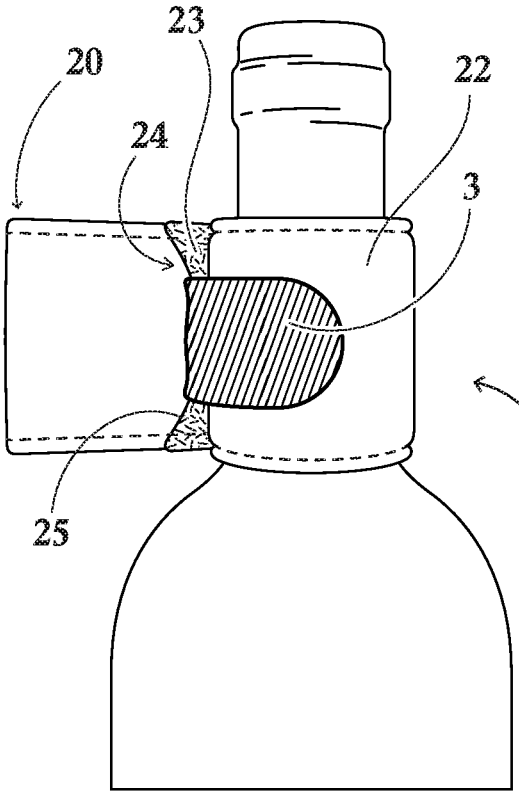
FIGS. 18A-18D respectively show two opposite views of the drip catcher of FIG. 16 fitted to the neck of a bottle, a top view of the drip catcher of FIG. 16 attached to the neck of a bottle and a detail of said drip catcher.
Figure 18B:
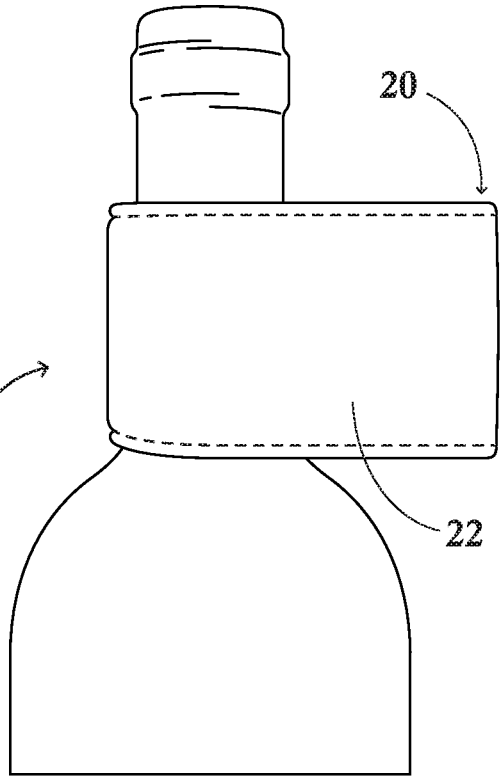

According to this embodiment, as shown in the FIGS. 17A and 17B, the drip catcher may be placed on a magnetic bar 17 like the ones placed above sinks or cookers given that—due to the uncovered end portion 32—it can be hung thereon and—as a result—the cloth strip 2 can be easily removed with one hand to replace it with another one of another kind, colour or pattern, or given that it can be washed (therefore leaving the strip 3 easily placed on the magnetic bar). In addition, once fitted to the neck of a bottle (FIGS. 18A and 18B), the first end 20 of the cloth remains vacant "in a flag-like fashion" and it can bear writings or logos clearly visible at will.

Figure 18C:
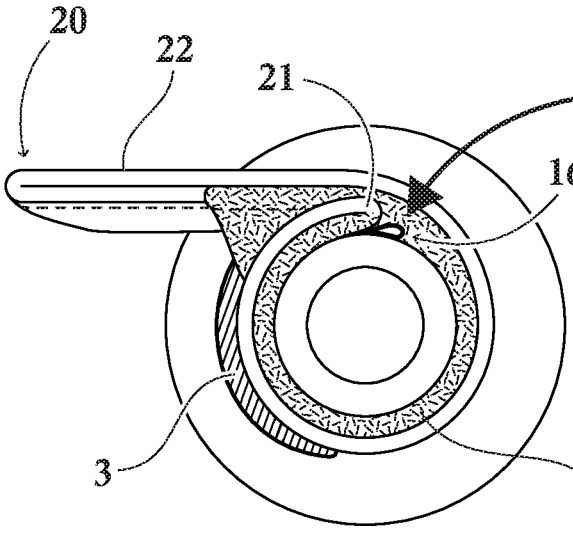
Figure 18D:
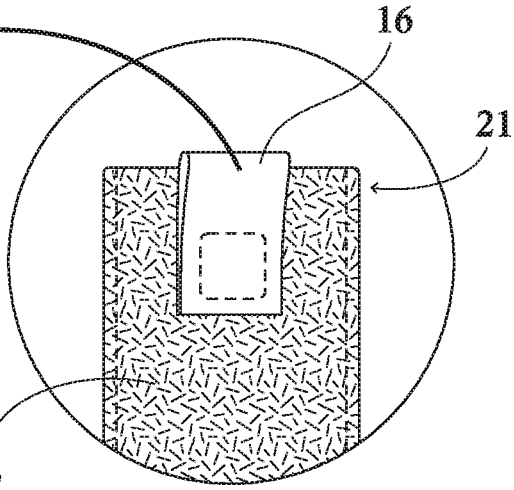

Advantageously, furthermore, the second end 21 of the cloth strip 2 comprises a tongue 16 attached on the second surface 23. This tongue may be a simple piece of cloth, with a single layer or folded with a slot, as shown in the figures. The tongue has the function of creating a sort of thickness given that in some cases, as shown in FIGS. 18C-18D, once the drip catcher has been folded on the neck of the bottle, there may be formed a space due to the superimposition of the cloth strip 2 with the strip 3 on the end edge of the second end 21 so as to form a step (not shown in FIG. 18C) which hinders the total adherence around the neck of the bottle. Therefore, the tongue would fill up such space therefore preventing the liquid from passing through it and dripping.

The aforementioned drip catcher may be without slots so that it can be hung and activating elements like the ones described above.

All the pocket variants and all elements and components described above can be adapted and combined with each other.

The invention claimed is:

1. A drip catcher to be fitted to a neck of containers, comprising a cloth strip having at least one absorbent surface, and provided with means for reversibly fitting around the neck, wherein the cloth strip comprises a pocket for housing the fitting means, formed by a metal strip extending on a rectilinear axis, has a curved cross-section with a first concave surface and a second convex surface, is elastically deformable adapting to the neck by pressing with fingers of one hand.

2. The drip catcher according to claim 1, wherein the cloth strip extends on a longitudinal axis from a first end to a second end, comprises a first surface, a second absorbent surface opposite to the first surface, an opening for inserting the metal strip into the pocket.

3. The drip catcher according to claim 1, wherein the metal strip is made of harmonic steel.

4. The drip catcher according to claim 1, further comprising an activation element of the metal strip, which can be positioned transversally astride the first concave surface of an end thereof.

5. The drip catcher according to claim 1, wherein the cloth strip comprises an extension of the first end so as to have a main portion containing the pocket and a second auxiliary portion extending from the first end and carries a slot.

6. The drip catcher according to claim 5, wherein the second auxiliary portion carries the activation element.

7. The drip catcher according to claim 1, wherein the cloth strip comprises an extension of the first end so as to have a main portion containing the pocket and a second auxiliary portion which extends from the first end and it is formed by a rigid ring which can be folded on the strip to position a portion thereof transversely astride on a metal strip on the concave surface thereof.

8. The drip catcher according to claim 4, wherein the activation element, the slot or the rigid ring may be made of magnetic iron material.

9. The drip catcher according to claim 1, comprising an elastic ring for engaging a cap of the container or for hanging the drip catcher on a support hook.

10. The drip catcher according to claim 4, wherein the activation element is formed by: a flat and rectangular plate, two bars made of rigid material in a X-cross position, three parallel bars made of rigid material, or a single rigid serpentine, each being welded or glued astride on the raised edges of the metal strip or fitted reversibly.

11. The drip catcher according to claim 2, wherein the opening is a fissure along a longitudinal edge of the cloth strip, a window of various shapes of the first surface of the strip, an opening which extends on almost all the surface leaving two pockets at the ends of the cloth strip for engagement with corresponding ends of the metal strip.

12. The drip catcher according to claim 2, further comprising a cover reversibly attached to the first surface of the cloth strip.

13. The drip catcher according to claim 1, wherein the pocket of the cloth strip leaves an end portion of the metal strip uncovered at least at one side.

14. The drip catcher according to claim 2, wherein the second end of the cloth strip comprises a tongue attached on the second surface.

* * * * *